US009057142B2

(12) United States Patent
Freckmann et al.

(10) Patent No.: US 9,057,142 B2
(45) Date of Patent: Jun. 16, 2015

(54) SELF-LUBRICATING COATING AND METHOD FOR PRODUCING A SELF-LUBRICATING COATING

(75) Inventors: Dominique Freckmann, San Francisco, CA (US); Helge Schmidt, Speyer (DE)

(73) Assignees: Tyco Electronics AMP GmbH, Bensheim (DE); Tyco Electronics Corporation, Berwyn, PA (US)

( * ) Notice: Subject to any disclaimer, the term of this patent is extended or adjusted under 35 U.S.C. 154(b) by 239 days.

(21) Appl. No.: 13/388,949

(22) PCT Filed: Jul. 30, 2010

(86) PCT No.: PCT/EP2010/061125

§ 371 (c)(1),
(2), (4) Date: Feb. 3, 2012

(87) PCT Pub. No.: WO2011/015531

PCT Pub. Date: Feb. 10, 2011

(65) Prior Publication Data

US 2012/0129740 A1 May 24, 2012

(30) Foreign Application Priority Data

Aug. 6, 2009 (DE) ..... 10 2009 036 311

(51) Int. Cl.

| | |
|---|---|
| ***C10M 125/04*** | (2006.01) |
| ***C25D 15/00*** | (2006.01) |
| *H01B 5/00* | (2006.01) |
| *H01R 13/03* | (2006.01) |

(52) U.S. Cl.

CPC ..... *C25D 15/00* (2013.01); *C10M 125/04* (2013.01); *H01B 5/00* (2013.01); *H01R 13/03* (2013.01)

(58) Field of Classification Search

USPC ..... 508/110

See application file for complete search history.

(56) References Cited

U.S. PATENT DOCUMENTS

| | | | | |
|---|---|---|---|---|
| 5,008,128 | A * | 4/1991 | Kudo et al. | 427/130 |
| 2004/0081574 | A1 * | 4/2004 | Poszmik et al. | 419/66 |

(Continued)

FOREIGN PATENT DOCUMENTS

| | | | |
|---|---|---|---|
| DE | 102007017380 | A1 * | 10/2008 |
| EP | 1197587 | A2 | 4/2002 |
| WO | WO 98/23444 | | 6/1998 |

(Continued)

OTHER PUBLICATIONS

International Preliminary Report on Patentability, issued by The International Bureau of WIPO, Geneva, Switzerland, dated Feb. 7, 2012, for International PCT Application No. PCT/EP2010/061125; 8 pages.

(Continued)

*Primary Examiner* — Taiwo Oladapo

(74) *Attorney, Agent, or Firm* — Faegre Baker Daniels LLP

(57) ABSTRACT

The invention relates to a coating (7) made up of a metal layer (8), in which a lubricant (1) which can be released by wear is embedded. In order to provide a wear-resistant coating (7) which is simply structured and economical to produce, the invention provides for the lubricant (1) to consist of an at least singly branched organic compound (2). The present invention further relates to a self-lubricating component (11) with a coating (7) according to the invention applied at least in certain portions, to a method for producing a coating (7), and also to a coating electrolyte (10) comprising at least one type of metal ions and at least one lubricant (1) consisting of an at least singly branched organic compound (2).

7 Claims, 2 Drawing Sheets

(56) References Cited

U.S. PATENT DOCUMENTS

| | | | | |
|---|---|---|---|---|
| 2006/0094309 | A1 | 5/2006 | Holtkamp et al. | |
| 2010/0116668 | A1 * | 5/2010 | Landau et al. | 205/50 |

FOREIGN PATENT DOCUMENTS

| | | | |
|---|---|---|---|
| WO | WO 2006/082179 | A1 | 8/2006 |
| WO | WO 2008/122570 | A2 | 10/2008 |

OTHER PUBLICATIONS

International Search Report and Written Opinion issued by the European Patent Office, dated Mar. 23, 2011, for related International Application No. PCT/EP2010/061125; 13 pages.

Zhu Liqun, et al, "Electrodeposition of Composite Copper/Liquid-Containing Microcapsule Coatings", Department of Materials Science and Engineering, Beijing University of Aeronautics and Astronautics, Beijing 10083, People's Republic of China; *Journal of Materials Science*, vol. 39 (2004), pp. 495-499.

Itzik Yosef, et al, "Metal-Organic Composites: The Heterogeneous Organic Doping of the Coin Metals—Copper, Silver, and Gold", Institute of Chemistry, The Hebrew University of Jerusalem, Jerusalem 91904, Israel; *American Chemical Society*, (2006), vol. 18, pp. 5890-5896.

Hanna Behar Levy, et al, "Entrapment of Organic Molecules within Metals. 2. Polymers in Solver", Institute of Chemistry, The Hebrew University of Jerusalem, Jerusalem 91904 and Faculty of Chemical Engineering, Technion, Haifa 32000, Israel; *American Chemical Society*, (2004), vol. 16 pp. 3197-3202.

* cited by examiner

SELF-LUBRICATING COATING AND METHOD FOR PRODUCING A SELF-LUBRICATING COATING

RELATED APPLICATION

This application is a national stage entry of PCT/EP10/61125 filed Jul. 30, 2010, which claims priority of German Patent Application No 10 2009 036 311.4, filed Aug. 6, 2009, which are incorporated by reference in their entirety.

The present invention relates to a coating made up of a metal layer, in which a lubricant which can be released by wear is embedded. The present invention further relates to a self-lubricating component with a coating applied at least in certain portions, to a method for producing a coating and a self-lubricating component, and also to a coating electrolyte comprising at least one type of metal dissolved as an ion or complex and at least one lubricant.

It is known in the art that coatings can influence the physical, electrical and/or chemical properties at the surface of a material. The surface can be treated with the aid of surface engineering methods in such a way, for example, that the surface coating offers mechanical protection from wear, displays corrosion resistance, is biocompatible and/or has increased conductivity.

In plug-in connection contacts and in press-in connectors, their tribology and wear often determines the number of possible actuations and ensures that they work properly. Friction-reducing and thus wear-reducing oilings/greasings applied externally to the components of plug-in connections and press-in connections are effective only with limited actuations and not in the long term either and can also change chemically.

It is therefore desirable to obtain coatings which increase wear resistance in a longer-lasting manner.

WO 2008/122570 A2 discloses a coating for a component, for example the electrically conductive portion of a plug, having a matrix with at least one matrix metal. Nanoparticles, which have an average size of less than 50 nm and each have at least one function carrier, are embedded in the metal matrix. The function carrier serves to influence the properties of the matrix in the desired sense. For example, a metal as a function carrier can alter the conductivity of the coating. Function carriers made of particularly hard materials, such as silicon carbide, boron nitride, aluminium oxide and/or diamond, can increase the hardness of the matrix and improve the wear behaviour of the coated component.

A wear-reducing coating of a component that renders an additional lubrication thereof unnecessary is for example known from EP 0 748 883 A1. The coating of said document is distinguished by a metal layer into which are introduced homogeneously distributed nanoparticles to which a friction-reducing substance is bound. The nanoparticle can for example consist of $Al_2O_3$, ZrO or $TiO_2$ and have a soap compound attached to its surface.

The coatings of EP 0 748 833 A1 and WO 2008/122570 A2 have the drawback that the actual function carriers, which influence the properties of the surface coating, are embedded into the metal layer while coupled to a carrier. This coupling leads to additional method steps, increasing material consumption and higher costs of the coating.

The object of the present invention is therefore to provide an improved wear-resistant coating which is simply structured and economical to produce.

According to the invention, the coating mentioned at the outset and the above-mentioned coating electrolyte achieve this object in that the lubricant embedded in the metal layer consists of an at least singly branched organic compound.

The method mentioned at the outset for producing the coating according to the invention achieves this object by the steps:

a) adding at least one lubricant consisting of an at least singly branched organic compound to an electrolyte solution having at least one type of metal dissolved as an ion or complex; and b) depositing the dissolved metal and the lubricant from the electrolyte solution as a coating onto a component.

In the present invention, the organic compound embedded in the metal layer is the lubricant which is partly exposed during abrasion and wear of the coating according to the invention on the surface of the coating and forms a wear-reducing lubricating film there. A carrier element, such as the inorganic nanoparticles of WO 2008/122570 A2 or EP 0 748 883 A1, is not required, so that bonding of the function carrier, i.e. the metals of WO 2008/122570 A2 or the soap compounds of EP 0 748 883 A1, to the carrier particles in a further method step is dispensed with in the present invention.

Because the desired lubricating effect of the coating according to the invention is already achieved in a minimally monoatomic intermediate layer of the organic lubricating compound or a portion thereof during contacting of two layers, the wear resistance of the coating according to the invention is increased by a multiple, so that the required layer thicknesses can be reduced, leading to reduced consumption of raw materials and a saving of costs.

Organic compounds are all compounds of carbon, except for the exceptions from inorganic chemistry, for example carbides, with itself and other elements, for example H, N, O, Si, B, F, Cl, Br, S, P or combinations of these elements, including those containing little carbon, for example silicones.

The solution according to the invention can be further improved by a number of configurations which are each independent of one another. These configurations and the advantages associated therewith will be briefly described hereinafter.

Preferably, the organic compound has a substantially three-dimensional molecular structure. A three-dimensional and thus compact molecular structure has the advantage that the lubricant molecules are distributed more uniformly in the electrolyte solution and the risk of agglomerations and clumping is reduced. It is thus possible to achieve a particularly homogeneous distribution of the lubricant in the electrolyte solution and in the coating. However, it is also possible to use, depending on the application, organic compounds having a substantially chain-like or planar molecular structure, i.e. a substantially linear or sheet-like arrangement of the atoms in the organic compound.

In a preferred configuration, the organic compound, which will be referred to hereinafter also as the lubricating molecule or lubricant molecule, is a macromolecule. The term "macromolecule" refers to molecules which consist of the same or different atoms or groups of atoms and have at least 15 atoms along the distance of their maximum spatial dimension. Macromolecular lubricants of this type, which include polymers, have the advantage of being able to be used in a broad range of uses and can be optimally selected for the corresponding application. Care must merely be taken to ensure that the macromolecules and the chain constituent thereof, including copolymers, mixed polymers and block polymers, are selected in such a way that they have lubricating properties in the layer system provided of the contact and do not adversely influence the electrical properties. Furthermore, the compounds used as lubricants should of course be chemically stable in the electrolyte solutions used, for producing the coating which they should not adversely influence.

It has been found that in particular organic compounds having a maximum spatial dimension of about 10 nm, preferably of at most 3 nm, have particularly good lubricating properties. Furthermore, lubricating molecules of this order of magnitude are electrically conductive in the sense of tunnelling and can be used in electrically conductive coatings. The term "maximum spatial dimension" refers in this case to the largest extent of the molecule along a spatial axis, for example the diameter of a spherical or plate-shaped lubricant. This design corresponds substantially to a maximum chain length of about 200 atoms, preferably of about 60 atoms along the distance of the maximum dimension.

On account of the relatively low spatial dimension of the lubricating molecules used for the present invention, which is well below the order of magnitude of >50 nm in coatings of nanoparticles used, the metal grain size in the coating can be reduced into the nanoscale range of the lubricant molecules themselves.

The organic lubricant compound can be structured in particular dendritically, i.e. in a highly branched and markedly ramified manner. The high branching and pronounced ramification can be in both symmetrical and asymmetrical form. Dendritic substances and polymers as lubricating molecules are particularly advantageous with regard to good distribution in the electrolyte solution, have low viscosity and tend to form nanostructures, in particular nanoparticles.

In order to increase the embedding of the lubricant, the organic compound can have at least one functional group having an affinity for the metal of the metal layer. This causes lubricating molecules, which are located during the deposition process at a short distance from the metal layer, to move toward the metal layer and be deposited thereon. In principle, the affinity of the functional group to the metal layer should be higher than to the solvent of the electrolyte solution in order to promote embedding or deposition of the lubricant.

Agglomeration or complete coverage of the metal layer with the lubricating molecules does not take place, as the metal affinity of the functional group takes effect only in the diffusion layer, i.e. in direct proximity to the surface of the coating. In order to rule out the risk of agglomeration of the lubricant molecules in the electrolyte solution, it is possible to provide in the organic compound a functional group which leads to mutual repulsion of the individual lubricating molecules in the electrolyte solution. This functional group is preferably arranged terminally, i.e. at the end of a chain or the respective branch of the chain.

It is advantageous, both for the affinity to the metal layer and for the repulsion of the lubricating molecules from one another, if the corresponding functional group is arranged at the surface of the organic compound. The functional group is then exposed on the outside of the lubricant molecule and thus arranged where the lubricating molecules enter into contact with the metal layer or with one another in the electrolyte solution.

According to a particularly preferred embodiment, the functional group may be a thiol group which both has high affinity for metals and ensures, on account of its polarity, repulsions of the lubricating molecules from one another.

The selection of the functional group is also dependent on the metal layer of the coating according to the invention, the metal layer preferably being selected from the group of Cu, Ni, Co, Fe, Ag, Au, Pd, Pt, Rh, W, Cr, Zn, Sn, Pb and the alloys thereof. In particular a metal layer made of gold or silver interacts effectively, on account of the high affinity of the thiol group to these metals, with lubricating molecules having a thiol group.

The coating electrolyte according to the invention, such as is produced for example in step a) of the method according to the invention, comprises at least one metal ion and a lubricant consisting of at least one type of an organic compound according to one of the above-described embodiments that is embedded in the coating according to the invention.

The present invention further relates to a self-lubricating component with a coating applied at least in certain portions according to one of the above-described embodiments. In the component according to the invention, the coating is preferably attached to a surface of an electrical contact, so that, on account of the increased wear resistance which the coating according to the invention achieves, lower layer thicknesses can be applied with good contact resistance, leading to a reduction in size and simplification of the corresponding contact and also to a reduction in weight and lower consumption of raw materials.

The coating is particularly suitable for plugs and other connecting components, in particular parts of a plug-in connection or a press-in connection.

The invention will be described hereinafter in greater detail based on an exemplary embodiment and with reference to the drawings, in which.

Figure 1:
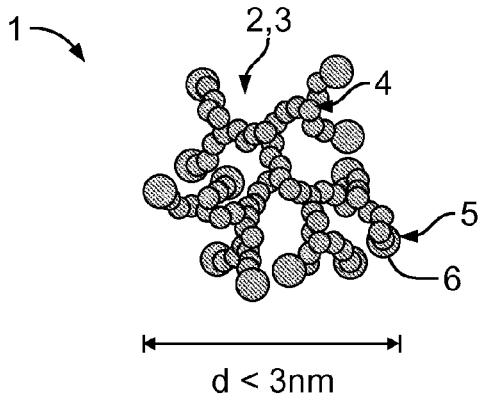
FIG. 1 is a schematic illustration of a preferred embodiment of a lubricant used in the present invention.
Figure 3:
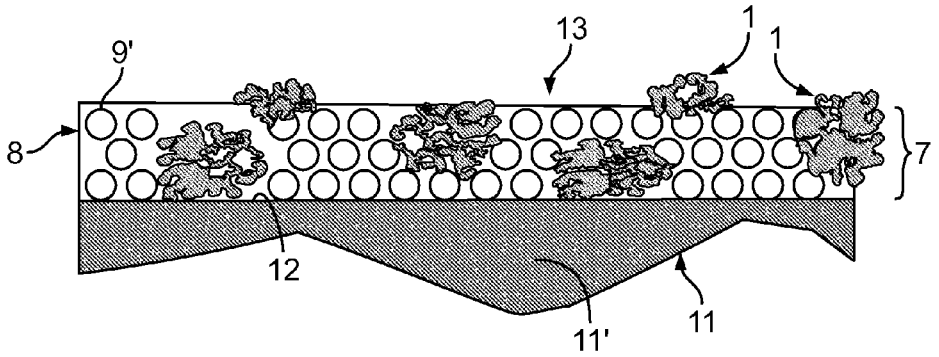
Figure 4:
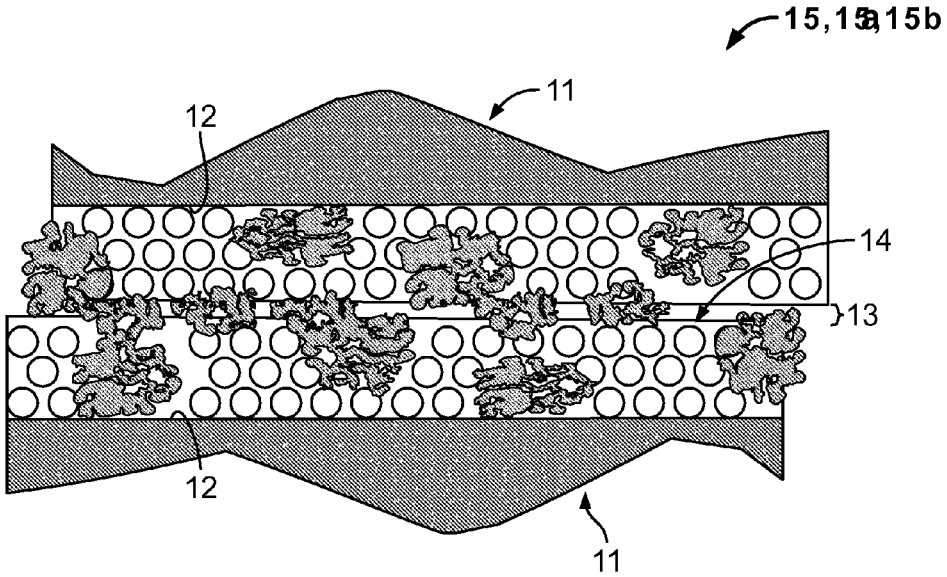

FIG. 3 is a schematic illustration of a detail of a self-lubricating component according to the present invention with the coating according to the invention applied, in which the lubricant of FIG. 1 is embedded; and FIG. 4 is a schematic illustration of a detail of the contact region of a connecting arrangement in which both connecting elements each have a coating according to the invention as shown in FIG. 3.

FIG. 1 shows a molecule of the lubricant 1 according to a preferred embodiment. The lubricant 1 consists of a highly branched organic compound 2, namely a dendritic polymer 3.

The polymer 3 is made up of interlinked monomer building blocks 4 which are linked in the markedly ramified structure to form the dendritic polymer 3 as an organic compound 2.

The dendritic polymer 3 according to the embodiment shown is a macromolecular organic compound 2 with a three-dimensional, substantially spherical molecular structure. The spatial dimension of this organic lubricant compound 2 is in the nanoscale range. The diameter, as the spatial dimension d of the spherical compound 2 shown, is <10 nm, preferably <3 nm.

Functional groups 5, in the embodiment shown thiol groups 6, are arranged at the surface of the organic compound 2. The thiol groups 6 are located preferably on the terminal monomer units, i.e. the terminal monomers 4 which in terms of structure are preferably arranged at the surface of a dendritic polymer 3.

The lubricant 1 shown in FIG. 1, which is made up of a functionalised, nanoscale organic lubricating compound 2, has, on account of the chemical structure and physical size of the polymer 3, good lubricating properties and may be effectively embedded, as a lubricant 1 which can be released by wear, into the metal layer 8 of a coating 7 according to the invention.

Figure 2:
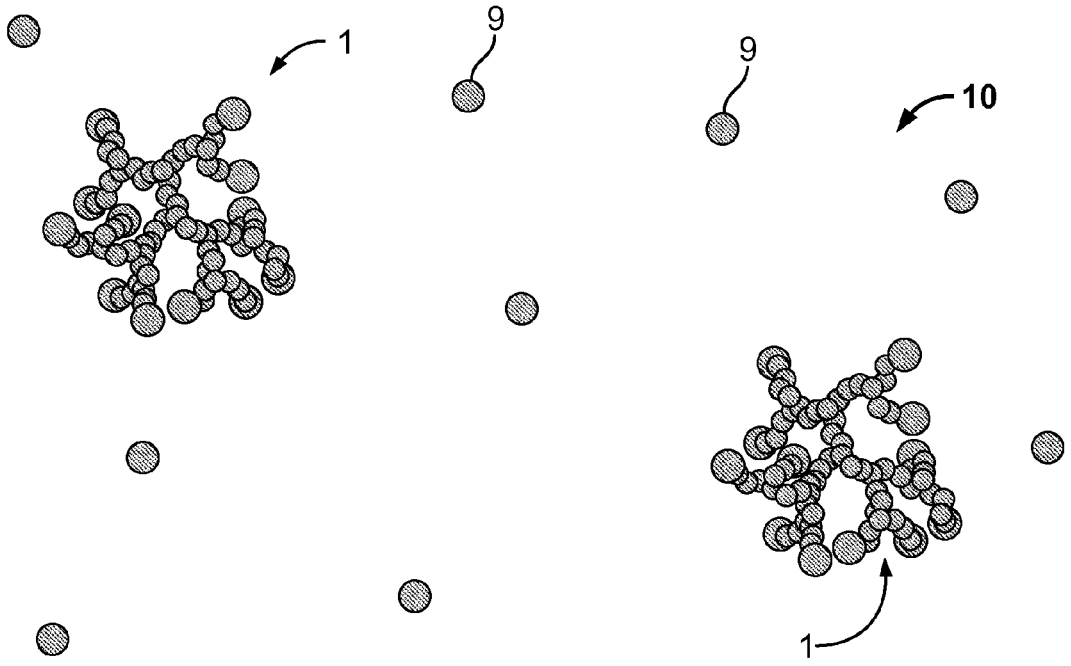
FIG. 2 is a schematic illustration of a coating electrolyte according to the invention comprising the lubricant of FIG. 1.

In order to produce a self-lubricating coating 7 according to the invention with the preferred lubricant 1 shown in FIG. 1, the lubricant molecules, i.e. the organic compound 2, are added to an electrolyte solution having a metal 9 dissolved as an ion or complex in order to produce a coating electrolyte 10 which is illustrated schematically in FIG. 2.

The coating electrolyte 10 comprises at least one type of metal ions 9 and at least one type of a lubricant 1 consisting of an at least singly branched organic compound 2 according to the present invention. It should be noted that FIG. 2 illustrates the coating electrolyte 10 according to the invention purely by way of example and schematically. In particular, the mixing ratio of metal ions 9 to lubricant 1 has been selected arbitrarily and generally does not correspond to the ratio at which the lubricant 1 is incorporated into the coating 7.

In order to produce the coating 7 according to the invention, the metal ions 9 from the coating electrolyte 10 are deposited on a component 11, the lubricating molecules 1 also being deposited and embedded in the metal layer 8. During this codeposition, which is preferably carried out electrochemically, the metal ions 9 crystallise out on the surface 12 to be coated as a metal layer 8 made up of metal atoms 9'. During the crystallisation, the lubricating molecules 1 are embedded in the metal layer 8 or deposited thereon, thus producing the composite coating 7 according to the invention as shown in FIG. 3.

The depositing and embedding of the lubricant 1 in the metal layer 8 is promoted by the functional groups 5 of the organic compound 2 which has, for example as a thiol group 6, an affinity to the metal layer 8, in particular if the metal layer comprises gold or silver.

In the embodiment shown in FIG. 3, the coating 7 according to the invention is applied to the surface 12 of an electrical contact 11'. A self-lubricating component 11 according to the present invention is obtained in this way. The coating 7 ensures higher wear resistance of the surface 12 of the component 11, as during abrasion the lubricant 1 is partly exposed at the surface of the coating 7, where it forms a lubricating film 14 in the contact region 13.

This may be seen particularly clearly in FIG. 4 which shows a connection 15, for example a plug-in connection 15*a* or a press-in connection 15*b*, in which the two components 11 which can be fitted together to produce the connection 15 are each provided in the contact region 13 with a coating 7 according to the invention on their surface 12.

FIG. 4 shows how individual molecules of the organic compound 2 are released from the coating 7 according to the invention by abrasion at the respective surface 12 of the coating 7 and form a lubricating film 14 in the contact region 13 when the components 11 of the connection 15 are joined together. This lubricating film 14 increases the wear resistance of the connection 15 on account of the good tribological properties of the lubricant 1, the organic lubricant compound 2 of which forms the lubricating film 14, as a result of which abrasion of the metal layer 8 is greatly reduced and the wear resistance of the component 11 is increased.

Although only one sort of lubricant 1 is used in the coating 7 according to the invention in the exemplary embodiment shown in the figures, it is of course also possible for different lubricants 1 to be embedded in the metal layer of the coating 7, provided that these different lubricants 1 each consist of an at least singly branched organic compound 2.

The invention claimed is:

1. Coating made up of a metal layer, in which a lubricant which can be released by wear is embedded, wherein the lubricant consists of an at least singly branched organic compound, and the organic compound is a macromolecule with a three-dimensional molecular structure and the organic compound has at least one thiol group.

2. Coating according to claim 1, wherein the organic compound has a maximum spatial dimension of about 10 nm.

3. Coating according to claim 1, wherein the organic compound is dendritically structured.

4. Coating according to claim 1, wherein the organic compound has at least one functional group having an affinity for the metal layer.

5. Coating according to claim 1, wherein the organic compound includes at least one functional group having an affinity for the metal layer, and the functional group is arranged terminally, and the thiol group is exposed at the surface of the organic compound.

6. Coating according to claim 1, wherein the metal layer is selected from the group of Cu, Ni, Co, Fe, Ag, Au, Pd, Pt, Rh, W, Cr, Zn, Sn, Pb and the alloys thereof.

7. A coating comprising:

a metal layer; and a lubricant embedded within the metal layer and can be released by wear, the lubricant consisting of an at least singly branched organic compound and the organic compound has a maximum spatial dimension of about 3 nm, wherein, the organic compound is a macromolecule with a three-dimensional molecular structure and the organic compound has at least one thiol group.

* * * * *